United States Patent [19]

Link

[11] 3,936,067

[45] Feb. 3, 1976

[54] SKI CLAMP

[75] Inventor: Reinhold G. Link, Dayton, Ohio

[73] Assignee: Linkspiel, Inc., Dayton, Ohio

[22] Filed: June 11, 1975

[21] Appl. No.: 585,978

[52] U.S. Cl... 280/11.37 A; 24/73 SG; 280/11.37 E

[51] Int. Cl.[2]..... A63C 11/02

[58] Field of Search..... 280/11.37 A, 11.37 K, 11.37 E, 280/11.37 T, 11.37 R; 224/45 S, 5 Z; 24/73 SG, 81 SK, 137 R, 137 A; 211/60 SK; 248/226 E, 74 A

[56] References Cited

UNITED STATES PATENTS

| | | | |
|---|---|---|---|
| 3,626,553 | 12/1971 | Darney et al. | 280/11.37 A |
| 3,683,462 | 8/1972 | Voigt | 280/11.37 A |
| 3,778,537 | 12/1973 | Miller | 248/74 A |
| 3,848,785 | 11/1974 | Bott | 211/60 SR |
| 3,861,701 | 1/1975 | Aring et al. | 280/11.37 A |

FOREIGN PATENTS OR APPLICATIONS

| | | | |
|---|---|---|---|
| 106,947 | 3/1943 | Sweden | 280/11.37 A |
| 533,064 | 2/1941 | United Kingdom | 280/11.37 E |

*Primary Examiner*—M. H. Wood, Jr.
*Assistant Examiner*—David M. Mitchell
*Attorney, Agent, or Firm*—Biebel, French & Bugg

[57] ABSTRACT

A clamp for holding a pair of skis in joined relation has an integral body with outwardly extending arms joined by a generally U-shaped neck portion, the arms and neck portion are resilient to accommodate flexing of the arms in a parting direction such that the arms will exert clamping force against a pair of skis fitted face to face between the arms. Each arm has a tip part including a shoulder facing inwardly of said clamp toward said neck portion so as to engage around an edge of a ski, and an outwardly extending ramp portion which will cause said arms to spread when the clamp is pushed lengthwise against an edge of the skis. The clamp also has a retainer section formed as part of the body of opposed ribs forming a pole receptacle which is generally parallel to said arms of the clamp.

4 Claims, 9 Drawing Figures

SKI CLAMP

BACKGROUND OF THE INVENTION

This application relates to a clamp or clip for holding a pair of skis for the purpose of storing and/or transporting them. Various types of such clamps have been suggested, most of them made of some form of metal, some rather complicated in structure, and difficult to manipulate.

By way of example, Norwegian Pat. No. 54,032 dislcoses various forms of clamps built from a strip of metal, some forms including loops which can also be used to embrace one or both ski poles to group the poles with the skis. German Pat. No. 458,728 discloses a similar, but simpler form of sheet metal clamp which is adjustable in width. U.S. Pat. No. 3,564,667 discloses sheet metal clamps in which the ends of the clamps form complementary parts of the pole holding loops, and these are overlapped such that insertion of the poles operates to hold the clamp in its closed position. German Pat. No. 473,301 discloses another form of sheet metal clamp with an internal spring for holding the skis in position within the clamp, with a hinged latch, and with pole holding loops riveted to the clamp. U.S. Pat. No. 3,683,462 discloses a clamp or clip which is basically molded of a thick rubber-like material, having metal reinforcing members or stiffening members molded into the clamp.

Somewhat more complex clamps or holder arrangements are dislcosed in U.S. Pat. No. 2,562,178, which utilizes two sheet metal holding members joined by springs. U.S. Pat. No. 3,626,553 discloses a clamp or clip which extends both between and around the skis, and includes a projection having arms between which the poles may be retained. U.S. Pat. No. 3,737,956 discloses a similar form of clamp where the skis are separated by a portion of the clamp body, and elastic cords are used to hold the poles in outwardly extending arm poritions, spaced on opposite sides of the joined skis. U.S. Pat. No. 3,486,672 discloses a flexible strap-like device which includes an auxiliary strap for holding the poles, together with appropriate buckles for each, or alternate apertures for receiving the poles.

In actual practice, the most widely seen form of clamp is simply an adjustable binding strap which is fitted around the skis and cinched tight, in some cases incorporating the poles within the loop of the strap.

All of these prior art devices have a common deficiency, namely there is no convenient way to store the clamps or clips when the skis are being used. Either the clamps are too bulky to be dropped into the skier's pocket, or if they do not fit within the pocket, they tend to become lost, or their buckles, etc., become clogged with snow and ice. In addition, they are difficult to manipulate, particularly so if the skier is wearing a pair of mittens.

SUMMARY OF THE INVENTION

The present invention provides a simple clamp for holding a pair of skis in paired relation for the purpose of storage and/or transportation. It is of simple construction which can readily be manufactured inexpensively, in large quantities, and which is sufficiently resilient even when exposed to cold weather or to relatively great temperature changes, to exert adequate clamping pressure to hold the skis together. The clamp provided by the present invention is generally U-shaped, and is provided with a reinforcing external rib which contributes to the resiliency and strength of the clamp, and the ends of the arms of the clamp terminate in edges which taper to a relatively sharp edge. These tapered end portions permit the clamp to be pushed with a wedging or cam-like action around a pair of skis placed in face to face contact, and the clamp end portions include shoulders which lock around the edges of the skis, once the clamp is fully in position, to prevent accidental dislodging of the clamp. This action can be accomplished easily, even with one hand, and while wearing mittens or the like since little or no dexterity is required to apply the clamp, or to remove it.

Along one arm of the clamp there is a holder in the form of outwardly extending ribs which define somewhat more than half of a cylinder, being arranged to fit or snap partially around a ski pole. The longitudinal axis of the holder is essentially parallel to the arm of the clamp, hence the clamp when not in use can be attached to a ski pole, and the body of the clamp extends parallel to the pole, out of the way where it is unlikely to become dislodged, and unlikely to interfere with the use of the pole. These clamps can readily be molded of suitable plastic materials, and they are sufficiently light in weight that, when stored on the pole, they do not add noticeably to the weight of the pole. Yet, they provide a convenient way of clamping skis together for storage or transporting.

The primary object of the invention, therefore, is to provide a novel clamp for joining a pair of skis, including a holder by which the clamp can be stored on a ski pole extending parallel to the shaft of the pole where the clamp is out of the way of the skier and yet quickly available for use; to provide such a clamp can be manufactured inexpensively in relatively large quantities; and to provide such a clamp which is easy to manipulate, which is capable of withstanding severe cold and wetness, and large temperature changes, while retaining its resilience and clamping strength.

Other objects and advantages of the invention will be apparent from the following description, the accompanying drawings and the appended claims.

DESCRIPTION OF THE PREFERRED EMBODIMENT

Figure 1:
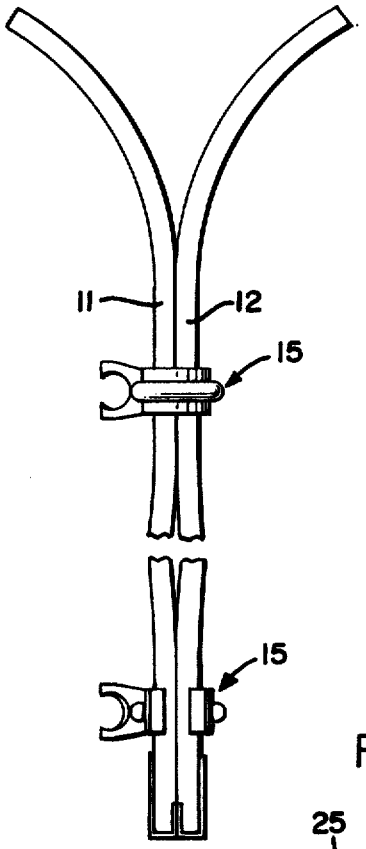
FIG. 1 is a view showing the clamps used to retain a pair of skis in carrying position, with the central section of the skis broken away to shorten the drawing.

Referring to FIG. 1, a pair of skis 11 and 12 are shown held in face to face carrying position by a pair of clamps provided by the invention, each indicated by the general reference numeral 15. For purposes of illustration the clamps are shown engaged oppositely across the pair of skis, although this orientation of the clamp is entirely optional with the user.

Figure 3:
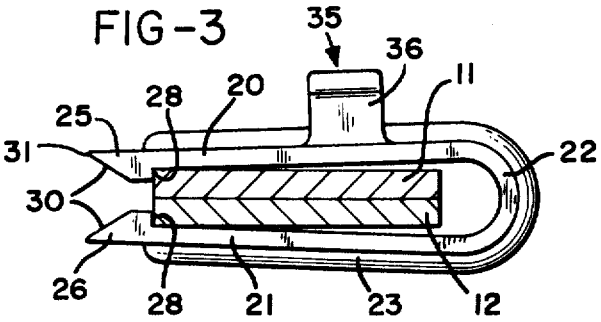
FIG. 3 is a view taken along lines 3—3 in FIG. 2, with the skis shown in cross-section.
Figure 4:
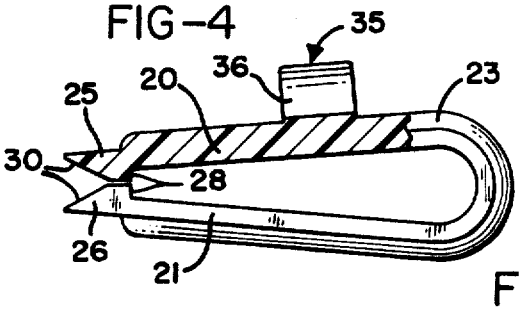
FIG. 4 is a view of the clamp alone, showing a portion of one arm of the clamp broken away and in cross-section.

Referring specifically to FIGS. 3 and 4, the clamp is constructed of an integral molded part having arms 20 and 21 joined by a neck portion 22, and a reinforcing or strengthening rib 23 is preferably formed extending entirely around the arms and neck portion, essentially from one tip or entrance part to the other. The clamp entrance parts or tips 25 and 26 preferably are symmetrical in configuration, and extend from the ends of the arms 20 and 21 as shown. Each tip or entrance portion has a shoulder 28 (FIG. 4) formed at its interior edge, and includes a tapered outwardly extending ramp part 30 which terminates in a relatively thin or sharp outer edge 31.

Figure 7:
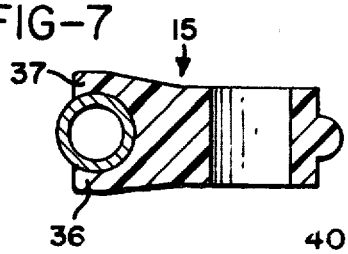
FIG. 7 is a cross-sectional view taken on lines 7—7 in FIG. 6.

Extending laterally from arm 20 is a U-shaped retainer section 35 formed of opposed ribs 36 and 37 (FIG. 7) which are shaped interiorly into a configuration which approximates a portion of a cylindrical surface. These surfaces are dimensioned so as to engage snugly around a pole, as hereafter described.

Figure 2:
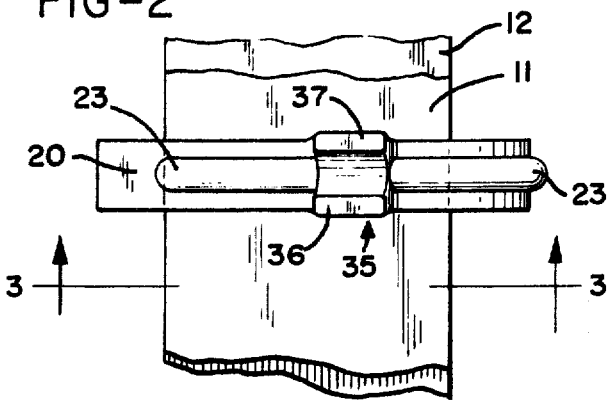
FIG. 2 is an enlarged view looking from the top of one of the clamps, with segments of the pair of skis shown engaged by the clamp.
Figure 5:
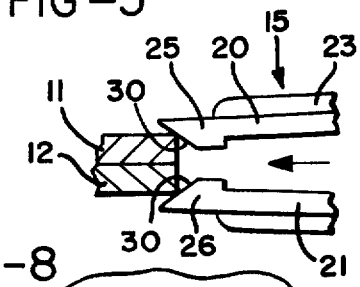
FIG. 5 is a fragmentary view showing the entrance ends of the clamp arms spread apart in the act of engaging around a pair of skis.

The interior dimension of the clamp, from the retaining edges or shoulder 28 to the inside of the neck portion 22 is sufficiently long to encompass a pair of skis, as will be apparent from FIGS. 2 and 3. The arms and reinforcing rib portion are so designed that in the normal unflexed state the end portions 25 and 26 are either engaged, or in closely spaced relationship, to each other. The natural resilience of the clamp is sufficient that when these skis are placed in face to face carrying or storage position, the clamp may be pushed with a lengthwise motion over the edges of the skis, as illustrated in FIG. 5, and the tapered ramp parts 30 function as a cam arrangement to cause the arms to spread and engage around the skis. Further thrust against the clamp moves it across the skis into the position shown in FIG. 3, where the shoulders drop around the opposite edges of the skis, and trap them within the confines of the clamp. If necessary, the clamp may then be moved longitudinally of the skis, either to the region where the ski bodies are thicker, or toward the tips where the pair of skis bend away from each other, in order to promote sufficient frictional engagement between the skis and the clamp to resist further longitudinal movement of the clamps lengthwise of the skis.

Figure 6:
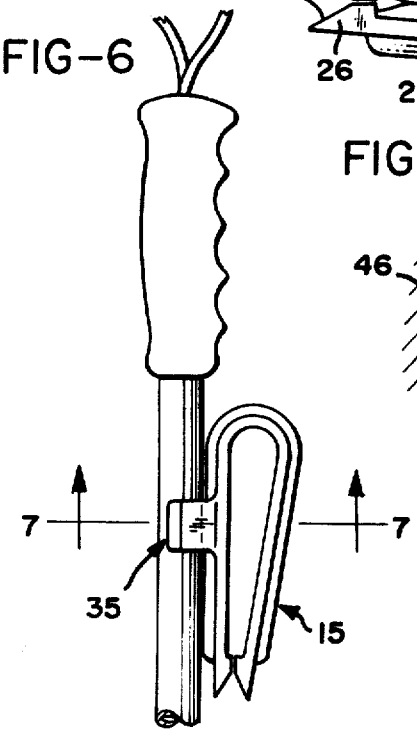
FIG. 6 is a view showing the upper end of a ski pole with one of the clamps in stored position thereon.

When the skis are to be used, the clamps are easily removed by grasping the end portions 25 and 26 and spreading them sufficiently to permit the clamp to be withdrawn. The clamps then store conveniently on the ski poles, by merely pushing the retainer 35 against the pole, below the handle of the pole, as shown in FIG. 6. The arms of the clamp extend lengthwise of the pole, and thus are so located that they do not interfere with the use of the pole. The clamps are light in weight, for example in the order of one ounce each, so they do not add any noticeable weight to the poles.

The clamps are so designed that they can be conveniently manufactured in large quantity by various molding processes, such as injection molding with suitable thermoplastic material. Various materials have been found suitable, for example, various forms of nylon used in such molding processes; however, a preferred material from the standpoint of continued clamping strength and resistance to substantial temperature variations, particularly very cold temperatures, is a fiber-filled cycolac material available under the trade name Carbasar-JS 4-10. Other suitable materials will suggest themselves to persons skilled in the art of such molded parts.

In addition to use as a clamp, and convenience in temporary storage while the skis are not in use, the clamps also provide a handy scraper for removing packed snow, ice, mud, etc., from the boots of a user, particularly before inserting the boots in the ski binding. The relatively sharp edges 31 have been found particularly advantageous in this respect, and the clamp can easily be grasped by the hand of the user, while wearing a mitten, to utilize these edges in such scraping activity.

As will be noted from FIG. 4, in its unstressed position the clamp has its tip parts close to or contacting each other. Thus, the clamp will also encompass and retain a single ski. For off-season storage the pair of clamps used to hold together a pair of skis (FIG. 1) can be used separately as a convenient storage aid.

Figure 9:
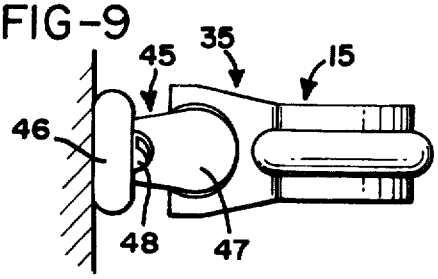
FIG. 9 is a view, partly in cross-section, showing engagement of a clamp with a storage holder.
Figure 8:
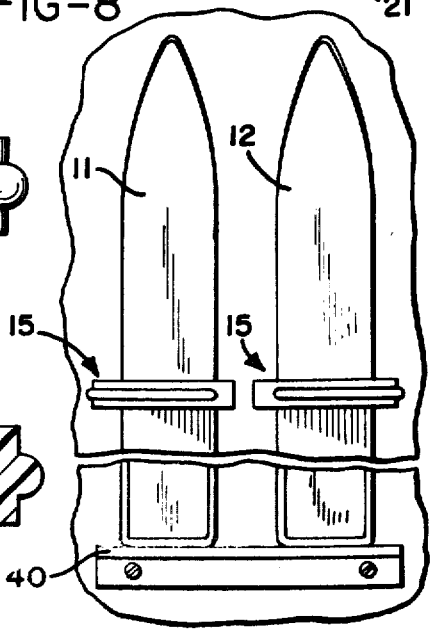
FIG. 8 is a view showing the clamps used for out of use storage of a pair of skis.

Thus, as shown in FIG. 8, a small shelf or plate 40 can be mounted to support the heel end of each ski on a flat surface such as a wall, closet door, or the like. Each of the clamps 15 is fitted around one of the skis with the retainer section 35 oriented toward the wall surface. The retainer section is fitted to a holder 45 which has a bar-like body 46 and an outwardly extending rod-like member 47 dimensioned to fit snugly within the clamp retainer section, as shown in FIG. 9. The holder 45 may be secured to the surface, at an appropriate distance above shelf 40, by a pair of screws 48. The entire holder 45 may also readily be manufactured as a simple molded part of plastic material, and a pair of holders may be supplied with each pair of clamps.

While the form of apparatus herein described constitutes a preferred embodiment of this invention, it is to be understood that the invention is not limited to this precise form of apparatus, and that changes may be made therein without departing from the scope of the invention.

What is claimed is:

1. A clamp for use in holding a pair of skis, said clamp comprising an integral body having outwardly extending arms joined by a generally U-shaped neck portion, said arms and neck portion being sufficiently resilient to accommodate flexing of said arms in a parting direction whereby said arms will exert clamping force against a pair of skis fitted between said arms, tip parts on each of said arms, at least one of said tip parts including a shoulder facing inwardly of said clamp toward said neck portion so as to engage around an edge of a ski, at least one of said tip parts having a ramp portion extending divergently toward its end from the other tip part so as to cause said arms to spread when the clamp is pushed along the length of said arms against an edge of the skis, and a retainer section formed as part of said body and including opposed resilient ribs forming a pole receptacle the axis of which is generally parallel to the outwardly extending direction of said arms of the clamp.

2. A clamp as defined in claim 1 wherein said body includes a continuous reinforcing rib extending around the exterior of said neck portion and along said arms.

3. A clamp as defined in claim 1 wherein each of said tip parts includes an inwardly facing shoulder, the shoulders being aligned with each other, and each of said tip parts is provided with a ramp portion.

4. A clamp for use in holding a pair of skis face to face, said clamp comprising an integral body of molded plastic material having outwardly extending arms with flat internal surfaces and joined by a generally U-shaped neck portion, which is a continuation of said arms, said arms and neck portion being stiff but sufficiently resilient to accommodate flexing of said arms in a parting direction whereby said arms will exert clamping force against skis fitted between said arms, tip parts on each of said arms, each said tip part including a shoulder facing inwardly of said clamp toward said neck portion so as to engage around an edge of a ski, at least one of said tip parts having a ramp portion extending divergently toward its end from the other tip part for causing said arms to spread when the clamp is pused along the length of said arms lengthwise against an edge of the skis, and a retainer section formed of opposed resilient ribs extending as an integral part of one of said arms about an axis which is generally parallel to the outwardly extending direction of said one arm providing a receptacle of part circular configuration adapted to attach to a ski pole.

* * * * *